United States Patent [19]

Halpin et al.

[11] Patent Number: 4,739,708

[45] Date of Patent: Apr. 26, 1988

[54] HOLDER FOR FLAMES OF PYROPHORE-CONTAINING FUELS IN HIGH-SPEED AIR

[75] Inventors: John L. Halpin, Ste-Foy; Kenneth D. Foster, Lac Beauport, both of Canada

[73] Assignee: Her Majesty the Queen in right of Canada, Canada

[21] Appl. No.: 14,350

[22] Filed: Feb. 13, 1987

[30] Foreign Application Priority Data

May 26, 1986 [CA] Canada ..... 510012

[51] Int. Cl.[4] ..... F42B 4/26

[52] U.S. Cl. ..... 102/336; 102/341; 102/343

[58] Field of Search ..... 102/336, 341, 343, 345, 102/338

[56] References Cited

U.S. PATENT DOCUMENTS

| | | | |
|---|---|---|---|
| 3,613,583 | 10/1971 | Lai et al. | 102/336 |
| 3,911,823 | 10/1975 | Murray et al. | 102/334 X |
| 3,914,093 | 10/1975 | Proctor | 102/336 X |
| 4,044,683 | 8/1977 | Ostroff | 102/336 X |
| 4,349,612 | 9/1982 | Baldi | 102/336 X |
| 4,418,623 | 12/1983 | Gauchard | 102/369 |

*Primary Examiner*—Peter A. Nelson

*Attorney, Agent, or Firm*—Stevens, Davis, Miller & Mosher

[57] ABSTRACT

A infrared flare is used as a military decoy for infrared heat seeking missiles. The flare burns a pyrophoric fuel to provide a good simulation of an aircraft spectral signature. To minimize blow-out under extreme wind and high altitude conditions, the flare has an oxygen injector arranged concentrically around the fuel ejector and a shroud sheltering an ignition space just downstream of the fuel ejector. The injected oxygen reacts with a small amount of the fuel to produce a pilot flame in the shroud.

7 Claims, 1 Drawing Sheet

HOLDER FOR FLAMES OF PYROPHORE-CONTAINING FUELS IN HIGH-SPEED AIR

FIELD OF THE INVENTION

The present invention relates generally to flares and has particular application to flares that serve as aerial sources of infrared (IR) radiation for target purposes.

BACKGROUND

IR flares are used as military decoys for infrared heat seeking missiles, for defensive or practice purposes. The flares that are now in use are made from a pyrotechnic magnesium-teflon composition. However, this composition is not entirely satisfactory for defeating more refined missle seeker-heads since the magnesium-teflon flare is a point source and radiates like a grey body, characteristics that do not adequately simulate the IR emissions from an aircraft. These deficiencies could be ameliorated if a pyrophoric fuel could be used instead of the traditional pyrotechnic materials.

The main advantages of pyrophoric fuels for flares are:

(a) Some pyrophoric fuels burn in much the same way as hydrocarbons, thus the infrared emission from pyrophoric flames is similar to that of kerosene. Thus, pyrophoric flares would give an infrared spectral signature much closer to the one given by an aircraft.

(b) Pyrophoric flames are extended sources and so the IR image of a pyrophoric flare would more closely resemble that of an aircraft.

(c) Pyrophoric fuels can use ambient air as an oxidizer. This allows a large proportion of the flare volume to be used for fuel.

(d) In principle, they ignite spontaneously in air,

Despite these advantages, pyrophoric flames have, until now tended to blow out under extreme wind and high altitude conditions. To the best of the applicant's knowledge, there is no pyrophoric fuel dispensing system now available that can, under these extreme conditions, successfully eject the fuel into the surrounding atmosphere to allow combustion with ambient air while anchoring the flame to the fuel dispensing system.

SUMMARY

According to the present invention there is provided a flare comprising:

(a) a supply of fuel;

a fuel ejector for ejecting a stream of the fuel into an ignition space;

(c) a supply of oxygen;

(d) oxygen injector means for injecting a flow of oxygen into the stream of fuel in the ignition space; and (e) a shroud sheltering the ignition space.

A small amount of oxygen injected into the stream of fuel quickly reacts with some of the fuel and initiates combustion very near the fuel ejector. This forms a pilot flame in the ignition space which is sheltered from the windstream by the shroud. The remaining fuel is thus preheated so that it burns more readily with the surrounding air.

BRIEF DESCRIPTION OF THE DRAWING

In the accompanying drawing, an exemplary embodiment of the present invention is illustrated, partially in cross section.

DETAILED DESCRIPTION

Figure 1:
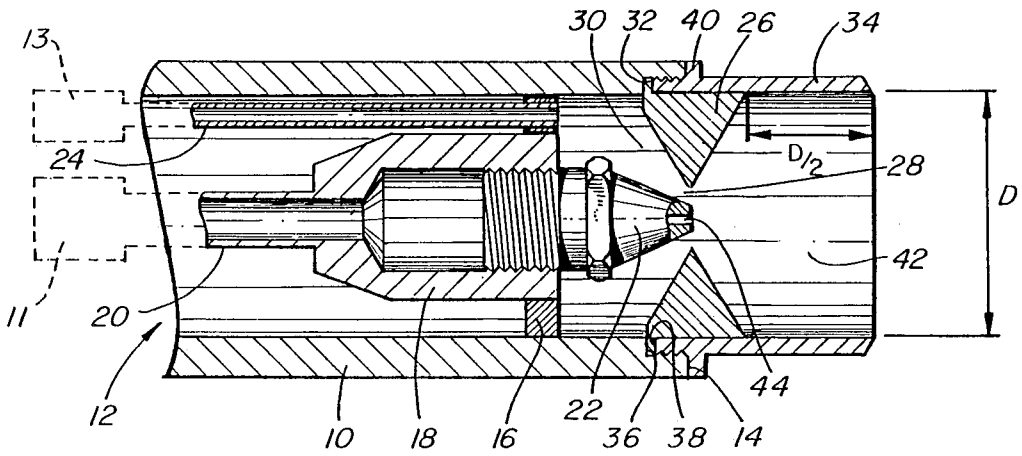

Referring to the drawing, the flare has a cylindrical housing 10 with an upstream end 12, only partially shown, that accommodates a supply of fuel 11 and a supply of oxygen 13. Slightly upstream from the downstream end 14 of the housing is a flange 16 that extends across and closes the housing 10. The flange carries an internally threaded female fitting 18 connected to the end of a fuel line 20 leading to fuel source 11. An orifice plug 22 is screwed into the fitting 18 and serves as a fuel ejector to eject a stream of fuel from the end 14 of the housing 10. The orifice plug 22 and the housing 10 are concentric. The orifice 44 of the plug is a plain, circular orifice.

An oxygen line 24 leading from the upstream oxygen source 13 is also fixed to, and passes through the flange 16.

Surrounding the downstream end of the orifice plug 22 is an oxygen deflector 26. This is an annular element of triangular cross section that defines an annular oxygen orifice 28 around the end of the plug 22. The deflector 26 defines, in cooperation with the housing 10 and the flange 16, an oxygen plenum 30 surrounding the orifice plug 22. The oxygen deflector 26 is held in place by means of an annular flange 32 on the deflector and a cylindrical shroud 34. The shroud is threaded into a threaded counterbore in the housing to capture the flange 32 between a shoulder 36 on the housing 10 and the end of 38 of the shroud 34. When the shroud is screwed fully into the housing an external annular flange 40 on the shroud abuts the end of the housing. Downstream of the oxygen deflector 26, the shroud defines an ignition space 42 that has a length (D/2) that is one half the internal diameter (D) of the shroud.

In operation, the pyrophoric fuel is ejected through the orifice 44 of the orifice plug 22 into the ignition space 42. An annular flow of oxygen passes from the plenum 30 through the annular oxygen orifice 28. The deflector 26 directs the oxygen flow radially inwardly into the stream of fuel thus improving atomization of the fuel. The flow rates are regulated such that the oxygen injected will burn approximately 3% of the fuel. The oxygen quickly reacts with the fuel and initiates combustion very near the ejector, thus forming a pilot-type flame in the ignition space 42.

Injection of the oxygen flow as close to the fuel flow as possible provides for a rapid mixing of the two streams. For this purpose, the diameter of the annular oxygen orifice 28 is desirably no more than twice the diameter of the fuel orifice 44.

While one embodiment of the present invention has been described in the foregoing, it is to be understood that other embodiments are possible within the scope of the present invention. Thus, the dimensions and positional relationships of the exemplary embodiment are illustrative only and may be altered within relatively wide limits while still providing the benefits of the invention.

We claim:

1. A flare comprising:

(a) a supply of pyrophoric fuel;

(b) means defining an ignition space for the fuel; said means comprising an annular housing;

(c) a fuel ejector for ejecting a stream of the fuel into the ignition space;

(d) a supply of oxygen;

(e) oxygen injection means positioned upstream of said fuel ejector for injecting a flow of oxygen into said annular housing; and (f) a shroud, said shroud positioned downstream of said oxygen injection means including mans extending radially inwardly from said housing constricting and deflecting the flow of oxygen into the vicinity of the fuel ejector so as to cause spontaneous ignition of the fuel.

2. A flare according to claim 1, wherein the fuel ejector has a circular ejector orifice.

3. A flare according to claim 2, wherein the oxygen injector means comprise means providing an annular oxygen plenum around the fuel ejector and an annular oxygen orifice concentric with the fuel ejector orifice.

4. A flare according to claim 3, wherein the means extending radially inwardly comprises oxygen flow directing means for directing the oxygen flow radially inwardly from the annular oxygen orifice into the stream of fuel.

5. A flare according to claim 1, wherein the annular housing is concentric with and surrounds the fuel ejector.

6. A flare according to claim 5, wherein the oxygen injector orifice surrounds the ejector.

7. A flare according to claim 6, wherein the shroud is a concentric extension of the housing.

* * * * *